United States Patent [19]

Reisinger et al.

[11] Patent Number: 4,740,743

[45] Date of Patent: Apr. 26, 1988

[54] SWITCHABLE BIPOLAR CURRENT SOURCE

[75] Inventors: Jochen Reisinger; Franz Dielacher, both of Villach, Austria

[73] Assignee: Siemens Aktiengesellschaft, Berlin and Munich, Fed. Rep. of Germany

[21] Appl. No.: 913,412

[22] Filed: Sep. 29, 1986

[30] Foreign Application Priority Data

Sep. 30, 1985 [DE] Fed. Rep. of Germany ..... 3534830

[51] Int. Cl.[4] ..... G05F 3/20

[52] U.S. Cl. ..... 323/316; 323/317; 307/496; 307/500

[58] Field of Search ..... 323/313, 314, 315, 316; 363/63; 307/496, 500, 262

[56] References Cited

U.S. PATENT DOCUMENTS

| | | | |
|---|---|---|---|
| 3,611,171 | 10/1971 | Black | 330/317 |
| 3,976,896 | 8/1976 | Ryder | 307/297 |
| 4,536,662 | 8/1985 | Fujii | 323/315 X |
| 4,544,878 | 10/1985 | Beale et al. | 323/315 |
| 4,583,037 | 4/1986 | Sooch | 323/315 |

FOREIGN PATENT DOCUMENTS 6095620 5/1985 Japan .

OTHER PUBLICATIONS

Hellwarth et al., "Precision Voltage Source with High-Speed Polarity Control", IBM Technical Disclosure, Oct. 1972, pp. 1590–1591.

Patents Abstract of Japan, vol. 8, No. 33, 14. Feb. 1984, p. P-254, 1470; & JP-A-58, 186817 (Nippon Denso), Oct. 31, 1983.

RCA Review, vol. 39, No. 2, Jun. 1978, pp. 250–258, Princeton, U.S., O. H. Schade: "Advances in BIMOS Integrated Circuits".

Electronics Letters, vol. 12, No. 15, Jul. 22, 1976, pp. 389, 390, Herts, GB; B. L. Hart et al., "DC Matching Errors in the Wilson Current Source".

*Primary Examiner*—Patrick R. Salce
*Assistant Examiner*—Kristine L. Peckman
*Attorney, Agent, or Firm*—Herbert L. Lerner; Laurence A. Greenberg

[57] ABSTRACT

A bipolar current source includes a supply voltage source, a first current reflector connected to the supply voltage source and having transistors of one conduction type including input and output transistor configurations, and a second current reflector connected in series with the first current reflector, connected to the supply voltage source and having transistors of the other conduction type including input and output transistor configurations, the output transistor configurations being able to be switched off.

17 Claims, 2 Drawing Sheets

SWITCHABLE BIPOLAR CURRENT SOURCE

The invention relates to a bipolar current source including a supply voltage source, a first current reflector having transistors of one type, a second current reflector having transistors of the other type, and input and output transistor configurations.

Current sources which can furnish a positive or negative output current are known in the art and are described, for instance, in the book "Halbleiter-Schaltungstechnik" (Semiconductor Switching Techniques) by U. Tietze and Ch. Schenk, Springer Publishers, Berlin, Heidelberg, New York, 1980, pages 54 et seq. A current source described therein delivers an output current which is proportional to an applied input voltage. It is customary to use a construction with one current source for the positive and one current source for the negative reference current followed by a multiplex circuit, for an application which requires either a positive or a negative reference current.

It is accordingly an object of the invention to provide a switchable bipolar reference current source, which overcomes the hereinafore-mentioned disadvantages of the heretoforeknown devices of this general type and which has a polarity that can be switched and a reference current that is adjustable.

With the foregoing and other objects of the invention in view there is provided, in accordance with the invention, a bipolar current source, comprising a supply voltage source, a first current reflector (i.e. current mirror) connected to the supply voltage source and having transistors of one conduction type including input and output transistor configurations, a second current mirror connected in series with the first current mirror, connected to the supply voltage source and having transistors of the other conduction type including input and output transistor configurations, and means for switching off the output transistor configurations.

In accordance with another feature of the invention, the input transistor configuration of the second current mirror includes an output circuit and the first current mirror includes a reflector transistor configuration having an output circuit connected in series with the output circuit of the input transistor configuration of the second current mirror.

In accordance with a further feature of the invention, the input transistor configurations include input transistors connected as diodes.

In accordance with an added feature of the invention, there is provided a first reference potential source, a second reference potential source, an operational amplifier having an inverting input connected to the second reference potential source, a non-inverting input and an output, and a resistor, the input transistor configuration of the first current mirror having an input transistor with a control input connected to the output of the operational amplifier and an output circuit connected through the resistor to the first reference potential source defining a junction point between the resistor and the output circuit of the input transistor, the junction point being connected to the non-inverting input of the operational amplifier, and the input transistor configuration of the second current mirror includes at least one input transistor connected as a diode.

In accordance with an additional feature of the invention, the current mirrors include transistors in the form of cascode transistor stages.

In accordance with yet another feature of the invention, the current mirrors include transistors in the form of a Wilson current source.

In accordance with yet an added feature of the invention, the current mirrors include transistors in the form of an improved Wilson current source.

In accordance with yet a further feature of the invention, the output transistor configurations each include an output transistor with a control terminal, and including first transistors each having an output circuit connected upstream of a respective one of the control terminals, and second transistors having output circuits each being connected in parallel to a respective one of the control terminals and to a respective one of the output terminals of the first transistors on the supply voltage side of the output transistor configurations.

In accordance with yet an additional feature of the invention, each of the output transistors has a given conduction type, each of the first transistors has a control terminal and a conduction type opposite to the output transistor connected thereto, and each of the second transistors has the same conduction type as the output transistor connected thereto, and including a common control terminal connected to the control terminals of the first transistors.

In accordance with still another feature of the invention, one of the output transistor configurations includes a respective output transistor with a control terminal, and including a first transistor having an output circuit connected to the the control terminal of said respective output transistor, and a second transistor having an output circuit connected in parallel to the control terminal and the to the output terminal of the first transistor on the supply voltage side of the one output transistor configuration.

In accordance with still a further feature of the invention, the output transistor has a given conduction type, the first transistor has a control terminal and a conduction type opposite to the output transistor, and the second transistor has the same conduction type as the output transistor, and including a control terminal connected to the control terminal of the first transistor.

In accordance with still an added feature of the invention, there is provided at least one and preferably two equal resistors connected between the mirror transistor configuration of the first current reflector and the input transistor configuration of the second current mirror.

In accordance with still an additional feature of the invention, the transistors of the current mirrors operate at the same operating point.

In accordance with a concomitant feature of the invention, the transistors are complementary metal oxide semiconductor transistors.

Other features which are considered as characteristic for the invention are set forth in the appended claims.

Although the invention is illustrated and described herein as embodied in a switchable bipolar current source, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
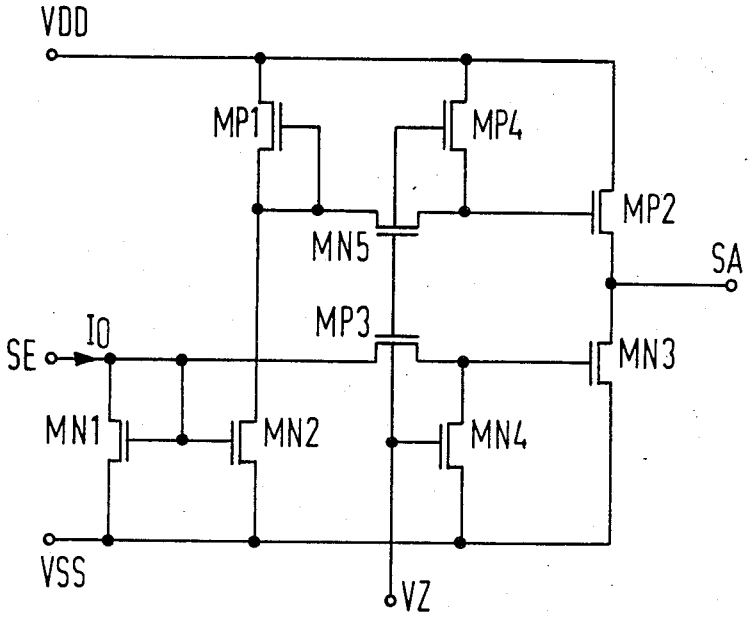
FIG. 1 is a schematic circuit diagram of a switchable bipolar current source according to the invention.

Referring now to the figures of the drawings in detail and first, particularly, to FIG. 1 thereof, it is seen that the circuit according to the invention is supplied by a voltage connected between two terminals VDD and VSS of a supply voltage source. The circuit contains a first current mirror with metal oxide semiconductor transistors of the n-channel type and a second current mirror with metal oxide semiconductor transistors of the p-channel type which are interconnected in series and have output transistors which are alternatingly driven by transistor switches. A current $I_0$ is fed into the first current mirror through a terminal SE. The first current mirror contains an input transistor MN1 which is connected as a diode; a mirror transistor MN2 and an output transistor MN3. While the gates of the transistors MN1 and MN2 are directly connected to each other and to the input terminal SE, the output circuit of a transistor MP3 is connected between the gate of the transistor MN3 and the input terminal SE. The terminals of the transistors MN1, MN2 and MN3 serving as the sources are connected to the terminal VSS of the supply voltage source. In addition, the output circuit of a transistor MN4 is connected in series with the gate of the transistor MN3 and the terminal VSS of the supply voltage source.

The output circuits of the transistors MP1 and MP2 of the second circuit mirrors are connected in series with the output circuits of the transistors MN2 and MN3. The gate of the transistor MP1 is connected directly to the junction point of the output circuits of the transistors MN2 and MP1 and it is also connected through the output circuit of a transistor MN5 to the gate of the transistor MP2. The terminals of the transistors of the second current mirror serving as the sources are connected to the terminal VDD of the supply voltage source. The gate of the transistor MP2 is also connected to the terminal VDD through the output circuit of a transistor MP4. A terminal SA for the current output of the circuit is connected at the junction point of the output circuits of the two output transistors MN3 and MP2. The transistors MN4 and MN5 are of the n-channel type in the illustrated embodiment and the transistors MP3 and MP4 are of the p-channel type; the gates of the last-mentioned four transistors are connected together to a terminal VZ.

The current $I_0$ flowing through the terminal SE into the circuit is first conducted into the mirror transistor MN2 by the transistor MN1 connected as a diode and therefore also flows through the input transistor of the second current mirror MP1. Depending on the sign of a potential at the terminal VZ, either the transistors MN4 and MN5 are cut off and the transistors MP3 and MP4 are switched into a conducting state or the operation thereof is reversed in pairs. It is essential for the invention that the output transistors of the two current mirrors can be switched off, especially alternatingly, which can also be accomplished by other switch configuration or other transistor types.

With a negative potential at the terminal VZ, the transistor MP3 conducts and the transistor MN4 is cut off. The input current $I_0$ is then cut off from the transistor MN3 accordance with the transformation ratio of the first current mirror, i.e., substantially according to the ratio of channel width to channel length of the transistor MN3 as compared to the transistor MN1. The current simultaneously flowing through the transistor MN2 and MP1 has no influence on the output current of the circuit since the transistor MN5 is cut off when a negative potential is present at the terminal VZ of the transistor MN5 and the transistor MP4 conducts so that the output transistor MP2 of the second current reflector is cut off.

With a positive potential at the terminal VZ, the conditions are exactly the reverse, i.e., the transistor MP3 is cut off and the transistor MN4 conducts so that the output transistor MN3 is cut off with certainty. On the other hand, since the transistor MN5 conducts in this case and the transistor MP4 is cut off, the input current $I_0$ is first mirrored according to the tranformation ratio of the transistor MN2 as compared to the transistor MN1 of the first current mirror, into the transistor MN2. The current which then also flows through the transistor MP1 is reflected in accordance with the transformation ratio of the second current reflector, i.e., according to the transformation ratio of the transistor MP2 as compared to the transistor MP1. Depending on the potential of the terminal VZ, the reference current flowing into the output terminal SA is either negative or positive.

Figure 2:
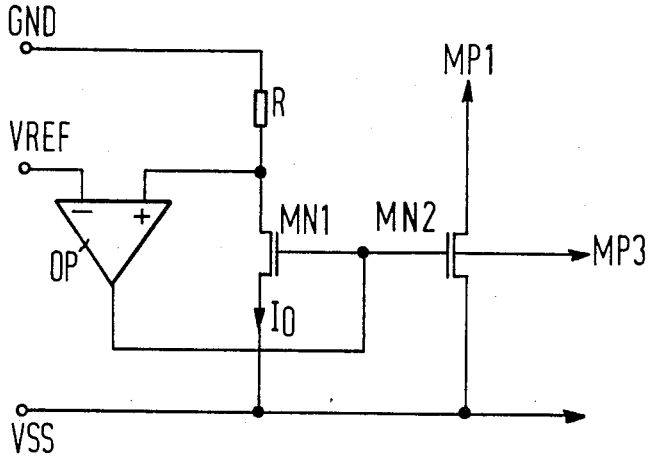
FIG. 2 is a circuit diagram of an embodiment of an input circuit for a bipolar current source which is switchable according to the invention.

FIG. 2 illustrates a different embodiment of the input circuit of the switchable bipolar current source according to FIG. 1. The terminal of the transistor MN1 serving as the drain connects the output circuit thereof through a resistor R to a terminal GND for connecting a reference potential. The terminal of the transistor MN1 serving as a source is connected to the pole VSS of the supply voltage source. The gate of the transistor MN1 and therefore the gate of the transistor MN2 and a terminal of the output circuit of the transistor MP3, are connected to the output of an operational amplifier OP. The inverting input of the operational amplifier is connected to a terminal VREF for connecting a reference potential and the non-inverting input thereof is connected to the junction point of the output circuit of the transistor MN1 and the resistor R. The rest of the circuit is constructed according to the embodiment of the invention illustrated in FIG. 1. According to the reference potential applied to the terminal VREF, the input current to be reflected which flows through the transistor MN1 is negatively fed back from the output of the operational amplifier OP through the transistor MN1 to the input of the operational amplifier and is thereby kept constant.

Another embodiment of a circuit according to the invention is provided, if the internal resistance of the current sources is to be increased. To this end, the transistors of the current reflectors can be provided according to the cascode principle, the Wilson principle or the improved Wilson principle, for instance.

Figure 3:
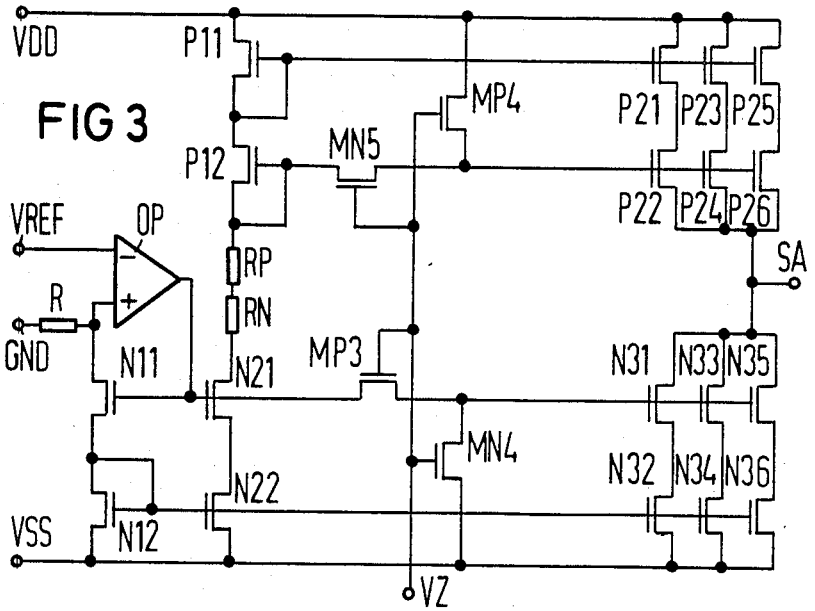
FIG. 3 is a circuit diagram of a current source according to the invention, which operates in accordance with the cascode principle.

FIG. 3 shows a circuit which operates according to he cascode principle with an input circuit according to FIG. 2. In the FIG. 3 embodiment, the transistors MN1, MN2 and MP1 according to FIG. 1 are replaced by series circuits each having two transistors N11 and N12, N21 and N22 as well as P11 and P12, respectively.

The gate and drain leads of the transistors N12, P11 and P12 are connected to each other. The transistors N11 and N12 are driven by an input circuit according to FIG. 2.

The output transistors MN3 and MP2 according to FIG. 1 are replaced by parallel circuits each having three transistors two of which are interconnected in series. The drain terminals of the transistors are connected to a common node, form the circuit output and are connected to a terminal SA. The jointly driven gates of the transistors N11 and N21 are connected to the gates of transistors N31, N33 and N35 through the output circuit of through transistor MP3. Similarly, the gate of the transistor P12 is connected to the gates of the transistors P22, P24 and P26 through the output circuit of the transistor MN5. The transistors N12, N22, N32, N34, N36 on one hand and the transistors P11, P21, P23 and P25 on the other hand, have a common gate drive. According to the invention, the cascode circuit according to FIG. 3, can be operated with only one switch combination MN4, MN5, MP3, MP4 according to FIG. 3, each of which acts on only gate circuit. A series circuit of resistors RN and RP which is connected between the drain terminals of transistors N21 and P12 causes the circuit to be symmetrized, i.e., equal operating points or equal drain-source voltages of the current mirror transistors if the load is connected from the terminal SA against the reference terminal GND. In that case, the junction point of the resistors RN and RP is virtually at the reference potential.

By connecting several output circuits in parallel, the reference output current can be increased in accordance with the changed transformation ratio of the current mirror, with the sameconfiguration of the transistors. If the ohmic load which is to be switched from the terminal SA against the reference terminal GND is chosen so as to be smaller than the resistor R according to the transformation ratio of the current mirror, the voltage drops across the load and the resistor R are of the same magnitude.

Figure 4:
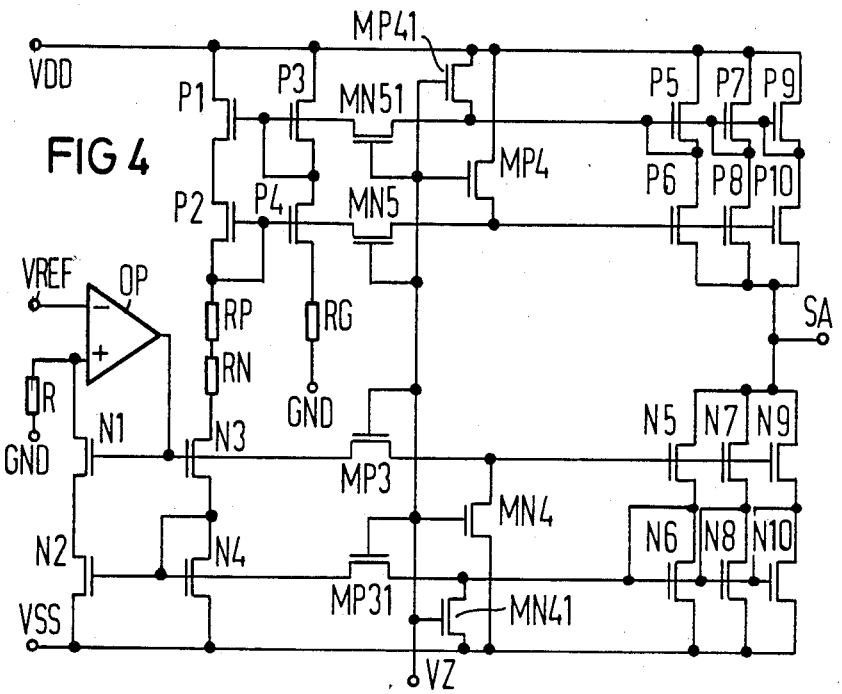
FIG. 4 is a circuit diagram of a current source according to the invention which operates in accordance with the improved Wilson principle.

FIG. 4 illustrates an embodiment of a circuit according to the invention operating according to the improved Wilson principle with an input circuit according to FIG. 2. A circuit according to this principle permits equal drainsource voltages of the transistors to be provided by connecting an additional transistor connected as a diode, as compared with a Wilson current source.

The circuit according to FIG. 4 is obtained by changing the circuit according to FIG. 3 as follows, wherein the reference symbols of the current source transistors have been changed. The drain-gate connections of the transistors N12 and P11 of FIG. 3 have been eliminated for transistors N2 and P1 of FIG. 4; drain-gate connections are provided instead for the transistors N22, N32, N34, N36, P21, P23 and P25 of FIG. 3, so that transistors N4, N6, N8, N10, P5, P7 and P9 are obtained in FIG. 4. In addition, the gate circuit of the output transistors which is not yet switched is equipped with switching transistors MN41, MN51, MP31 and MP41 which can be controlled by the terminal V2, and which respectively correspond to the transistors MN4, MN5, MP3 and MP4 for the other gate circuit.

Additionally, a series circuit formed of the output circuits of two transistors P3 and P4 as well as a resistor RG is connected from the terminal VDD to the reference terminal GND. The drain and gate of the transistor P3 are connected to each other and to the gate of the transistor P1, and the gate of the transistor P4 is connected to the gate of the transistor P2. This configuration makes the circuit symmetrical in order to assure the same operating points for all transistors. Similarly, the resistors RN and RP as well as R and an ohmic load which can be connected from the terminal SA against the reference potential, are provided to ensure equal operating points for the transistors, corresponding to the explanations given withregard to FIG. 3.

The circuits according to the embodiments of the invention illustrated in FIGS. 1 to 4 contain metal oxide semiconductor transistors, where the letters N or P of the reference symbols indicate the channel type. The teachings of the invention include a circuit configuration with metal oxide semiconductor transistors of the other type. However, this circuit can also be constructed with bipolar transistors. It is possible to increase the output reference current in a simple manner, especially in the embodiment with metal oxide transistors parallel to the output transistors, considering the channel type, or by increasing the ratio of channel width to channel length which essentially determines the current.

The foregoing is a description corresponding in substance to German Application No. P 35 34 830.5, dated Sept. 30, 1985, the International priority of which is being claimed for the instant application, and which is hereby made part of this application. Any material discrepancies between the foregoing specification and the aforementioned corresponding German application are to be resolved in favor of the latter.

We claim:

1. Bipolar current source, comprising a supply voltage source, a first current mirror connected to said supply voltage source and having transistors of one conduction type including input and output transistor configurations, a second current mirror connected in series with said first current mirror, connected in said supply voltage source and having transistors of the other conduction type, including input and output transistor configurations, and means for alternatingly switching off one of said output transistor configurations.

2. Bipolar current source according to claim 1, wherein said input transistor configuration of said second current mirror includes an output circuit and said first current mirror includes a mirror transistor configuration having an output circuit connected in series with said output circuit of said input transistor configuration of said second current mirror.

3. Bipolar current source according to claim 1, wherein said input transistor configurations include input transistors connected as diodes.

4. Bipolar current source according to claim 1, including a first reference potential source, a second reference potential source, an operational amplifier having an inverting input connected to said second reference potential source, a non-inverting input and output, and a resistor, said input transistor configuration of said first current mirror having an input transistor with a control input connected to said output of said operational amplifier and an output circuit connected through said resistor to said first reference potential source, a junction point between said resistor and said output circuit of said input transistor being connected to said non-inverting input of said operational amplifier, and said input transistor configuration of said second current mirror includes at least one input transistor connected as a diode.

5. Bipolar current source according to claims 1, wherein said current mirror include transistors in the form of cascode transistor stages.

6. Bipolar current source according to claim 1, wherein said current mirrors include transistors in the form of a Wilson current source.

7. Bipolar current source according to claims 1, wherein said current mirrors include transistors in the form of an improved Wilson current source.

8. Bipolar current source according to claim 1, wherein said output transistor configurations each include a respective output transistor with a control terminal, and including first transistors each having an output circuit connected to a respective one of said control terminals, and second transistors having output circuits each being connected in parallel to a respective one of said control terminals and to a respective one of said output terminals of said first transistors on the supply voltage side of said output transistor configurations.

9. Bipolar current source according to claim 8, wherein each of said output transistors has a given conduction type, each of said first transistors has a control terminal and a conduction type opposite to said output transistor connected thereto, and each of said second transistors has the same conduction type as said output transistor connected thereto, and including a common control terminal connected to said control terminals of said first transistors.

10. Bipolar current source according to claim 1, wherein one of said output transistor configurations includes a first output transistor with a control terminal, and including a first transistor having an output circuit connected to said control terminal of the first output transistor, and a second transistor having an output circuit connected in parallel to said control terminal and to said output terminal of said first transistor on the supply voltage side of said one output transistor configuration.

11. Bipolar current source according to claim 10, wherein said output transistor has a given conduction type, said first transistor has a control terminal and a conduction type opposite to said output transistor, and said second transistor has the same conduction type as said output transistor, and including a control terminal connected to said control terminal of said first transistor.

12. Bipolar current source according to claim 2, including at least one resistor connected between said mirror transistor configuration of said first current mirror and said input transistor configuration of said second current mirror.

13. Bipolar current source according to claim 12, wherein said at least one resistor is in the form of two equal resistors.

14. Bipolar current source according to claim 1, wherein said transistors of said current mirrors operate at the same operating point.

15. Bipolar current source according to claim 1, wherein said transistors are complementary metal oxide semiconductor transistors.

16. Bipolar current source, comprising a supply voltage source, a first current mirror connected to said supply voltage source and having transistors of one conduction type including input and output transistor configurations, a second current mirror connected in series with said first current mirror, connected to said supply voltage source and having transistors of the other conduction type including input and output transistor configurations, means for switching off said output transistor configurations, wherein one of said output transistor configurations includes a first output transistor with a control terminal, and including a first transistor having an output circuit connected to said control terminal of the first output transistor, and a second transistor having an output circuit connected in parallel to said control terminal and to said output terminal of said first transistor on the supply voltage side of said one output transistor configuration, said output transistor has a given conduction type, said first transistor has a control terminal and a conduction type opposite to said output transistor, and said second transistor has the same conduction type as said output transistor, and including a control terminal connected to said control terminal of said first transistor.

17. Bipolar current source, comprising a supply voltage source, a first current mirror connected to said supply voltage source and having transistors of one conduction type including input and output transistor configurations, a second current mirror connected in series with said first current mirror, connected to said supply voltage source and having transistors of the other conduction type including input and output transistor configurations, wherein said output transistor configurations each include a respective output transistor with a control terminal, and including first transistors each having an output circuit connected to a respective one of said control terminals, and second transistors having output circuits each being connected in parallel to a respective one of said control terminals and to a respective one of said output terminals of said first transistors on the supply voltage side of said output transistor configurations, each of said output transistors has a given conduction type, each of said first transistors has a control terminal and a conduction type opposite to said output transistor connected thereto, and each of said second transistors has the same conduction type as said output transistor connected thereto, and including a common control terminal connected to said control terminals of said first transistors.

* * * * *